US011073291B2

(12) United States Patent
Kellicker et al.

(10) Patent No.: US 11,073,291 B2
(45) Date of Patent: Jul. 27, 2021

(54) EXTERNAL CONTROL FOR HOT WATER RECIRCULATION PUMP

(71) Applicant: Taco, Inc., Cranston, RI (US)

(72) Inventors: Robert Kellicker, Upton, MA (US); Carl A. Perrone, Jr., East Greenwich, RI (US)

(73) Assignee: Iaco, Inc., Cranston, RI (US)

( * ) Notice: Subject to any disclaimer, the term of this patent is extended or adjusted under 35 U.S.C. 154(b) by 91 days.

(21) Appl. No.: 15/234,270

(22) PCT Filed: Feb. 11, 2015

(86) PCT No.: PCT/US2015/015470

§ 371 (c)(1),
(2) Date: Aug. 11, 2016

(87) PCT Pub. No.: WO2015/123336

PCT Pub. Date: Aug. 20, 2015

(65) Prior Publication Data

US 2018/0180303 A1 Jun. 28, 2018

Related U.S. Application Data

(60) Provisional application No. 61/938,963, filed on Feb. 12, 2014.

(51) Int. Cl.

| | |
|---|---|
| ***F24D 19/10*** | (2006.01) |
| ***E03B 7/04*** | (2006.01) |
| ***F24D 17/00*** | (2006.01) |

(52) U.S. Cl.

CPC ..... *F24D 19/1051* (2013.01); *E03B 7/04* (2013.01); *F24D 17/0078* (2013.01); *F24D 2220/0207* (2013.01)

(58) Field of Classification Search

CPC ..... A01G 25/16; H02J 3/14; F04D 15/0066; F24D 19/1051; F24D 17/0078; F24D 2220/0207; E03B 7/04

(Continued)

(56) References Cited

U.S. PATENT DOCUMENTS 4,527,247 A * 7/1985 Kaiser ..... A01G 9/26 700/278
5,577,890 A * 11/1996 Nielsen ..... F04B 49/065 318/729

(Continued)

FOREIGN PATENT DOCUMENTS

JP 2005331189 A * 12/2005
WO 20100122564 A1 10/2010

*Primary Examiner* — Rocio Del Mar Perez-Velez
*Assistant Examiner* — Alicia M. Choi
(74) *Attorney, Agent, or Firm* — Sutton Magidoff Barkume LLP

(57) ABSTRACT

An external control unit to be connected between a power source and an electrically driven pump to act as a smart switch to convert a "dumb" pump into a smart pump. The control system of this invention comprises a microcontroller-operated switch, located between the power source and the pump, or other fluid flow control device to be operated by electricity, and which can be programmed to record usage data of, e.g., hot water, by the household; it sets up the operating times in accordance with such usage. A temperature sensor is connected to the microcontroller to sense a temperature change, in a hot water system is turned on, by measuring an increase in temperature to indicate flow through the hot water pipe, and to record such data. This will determine, in the context of a hot water system, when the pump should be activated to bring up hot water.

3 Claims, 4 Drawing Sheets

(58) Field of Classification Search
USPC ..... 700/282
See application file for complete search history.

(56) References Cited

U.S. PATENT DOCUMENTS

| | | | | |
|---|---|---|---|---|
| 5,829,467 | A | 11/1998 | Spicher | |
| 6,212,894 | B1 | 4/2001 | Brown et al. | |
| 8,594,853 | B2 | 11/2013 | McNamara et al. | |
| 8,641,385 | B2 | 2/2014 | Koehl | |
| 9,951,780 | B2 * | 4/2018 | McKinzie | F04D 15/0066 |
| 2004/0154094 | A1 * | 8/2004 | Ostrowski | E03C 1/00 4/541.1 |
| 2008/0131296 | A1 * | 6/2008 | Koehl | F04D 15/0088 417/53 |
| 2011/0202293 | A1 * | 8/2011 | Kobraei | G06Q 50/06 702/62 |
| 2011/0231022 | A1 * | 9/2011 | McNamara | F24D 19/1051 700/282 |
| 2012/0073519 | A1 * | 3/2012 | Deivasigamani | F24D 19/1051 122/14.3 |
| 2012/0192965 | A1 | 8/2012 | Popper et al. | |
| 2013/0051777 | A1 | 2/2013 | Brian et al. | |
| 2013/0289780 | A1 | 10/2013 | McNamara | |
| 2014/0368152 | A1 * | 12/2014 | Pasche | F04B 49/02 318/805 |
| 2015/0066231 | A1 * | 3/2015 | Clifton | G05F 1/66 700/296 |
| 2018/0180303 | A1 * | 6/2018 | Kellicker | E03B 7/04 |

* cited by examiner

EXTERNAL CONTROL FOR HOT WATER RECIRCULATION PUMP

FIELD OF THE INVENTION

The present invention relates to a small, external unit for controlling a small water pump that will plug directly into a standard, properly grounded, 120 volt electrical wall outlet. The small unit contains an electronic control board that will operate a pump, i.e., turn a pump "on" and "off," that is, e.g., plugged into it, that is receiving the electrical power it needs to operate through the small, external control unit. It can provide at least two (2) modes of operation for the pump, i.e., a Smart Mode and a Pulse Mode.

DESCRIPTION OF THE RELATED ART

In many of the dry, or drought-plagued parts of North America, and possibly elsewhere, hot water is often continually circulated within the closed water system of a house or business, in order to have hot water substantially immediately available when a faucet is turned on; this avoids, or at least reduces, the wasting of flowing water while waiting for the hot water to reach a tap in a bathroom or kitchen of a home or office center. By circulating the hot water continuously to the most distant hot water tap, it becomes substantially immediately available at various other tap points in a system as needed, without sending any water down the drain.

In some prior systems, instead of continuously circulating the water in the system, a pump can be made to operate in a continual 'pulse' mode, i.e., on for a period and off for a period, on a continuing basis. For example, a pulse mode can comprise 150 seconds on and 10 minutes off, all day, every day, or only during certain pre-programmed time periods. The prior devices all utilized alternating house current to power relatively inefficient pumps, located either at or near the hot water tank; these were installed especially during new house construction, or located at the farthest tap site and pumping between the hot and cold water lines at those locations, for aftermarket installation in older buildings. There are older systems sold for aftermarket installation were generally of the type operating constantly, in response to a manual switch, or by a pulse mode switch, with alternating periods of operation and non-operation. More recently, pumps having an internal microcontroller controlled the pump operation in accordance with the prior actual usage by the household, in commonly owned U.S. Pat. No. 8,594,853, and copending application Ser. No. 14/080,489.

BRIEF SUMMARY OF THE INVENTION

The present invention reflects the novel recognition that many households have previously installed a simple manual or pulse mode pump, and did not want to go through the expense and time of buying a new smart pump. It has now been discovered that rather than purchasing an entirely new pump system, the external control unit of the present invention can be connected between the power source and the pump to act as a 'smart switch, to convert a 'dumb' pump into a smart pump. This invention is especially useful for use with the relatively small pump-motor combinations used to maintain a minimal flow of hot water, through a hot water system and returned to the hot water source, in order to provide substantially instantaneous hot water whenever a tap is turned on anywhere in the system. This system allows for a minimal loss of heat energy, especially during the winter in the northern states, in that water flow, and therefore the energy for heating water, is limited only by the temperature at which the user wants the hot water to be maintained.

It must be noted that this smart controller can be used to operate any system that is only sporadically used and where temperature is a primary determinant of operation.

The control system of this invention comprises a microcontroller-operated switch, located between the power source and the pump, or other device to be operated by electricity. The microcontroller can be programmed in accordance with an algorithm that can record usage data of, e.g., hot water, by the household and sets up the operating times in accordance with such usage; a temperature sensor is connected to the microcontroller in the switch unit, in order to sense a temperature change, such as when a hot water tap in a hot water system is turned on, by measuring an increase in temperature which indicates the existence of flow from the water heater into the hot water pipe, and to record such data. This will determine, in the context of a hot water system, when the pump should be activated to bring up hot water, and when the pump should be shut off. This microcontroller for this invention is similar to the microcontroller described in commonly owned U.S. Pat. No. 8,594,853.

In operation in the Smart Mode, the controller unit, during an initial operating period, operates the pump in the pulse mode, while sensing and measuring the usage periods of the household. Specifically, when set to Smart mode the following features will be included:

Data logging, e.g., of hot water usage;
Recirculation period;
Start Usage cycle;
End usage cycle;
Initial start-up; and
Running functions.

After the initial logging period has passed, the controller has determined when the household uses hot water, and in the second operating period, controls the pump to operate and to provide instantaneous hot water only during the usage periods that the household has previously used the hot water, starting the pump action a set time prior to each of the previous usage periods. During this second and succeeding logging periods of operation, the controller continues to sense and record the periods of use, changing or increasing the periods of operation in accordance with any changes of usage, during each subsequent logging period. The logging period measured is usually seven (7) days.

The system is preferably also programmed to turn off when the household is away for an extended period of time, for example on vacation, if there is no hot water usage during a predetermined extended period of non-usage time, e.g., 36 hours.

The extremely small pressure differential between the hot water and cold water pipes, especially when the cold water pipe also flows into a water heater, allows for a small pump and this permits this external controller to be able to handle the electrical power sufficient to operate such a small pump, usually having a motor of up to 0.5 horsepower or one drawing up to 6 amps. of current.

DETAILED DESCRIPTION OF THE INVENTION

Figure 1:
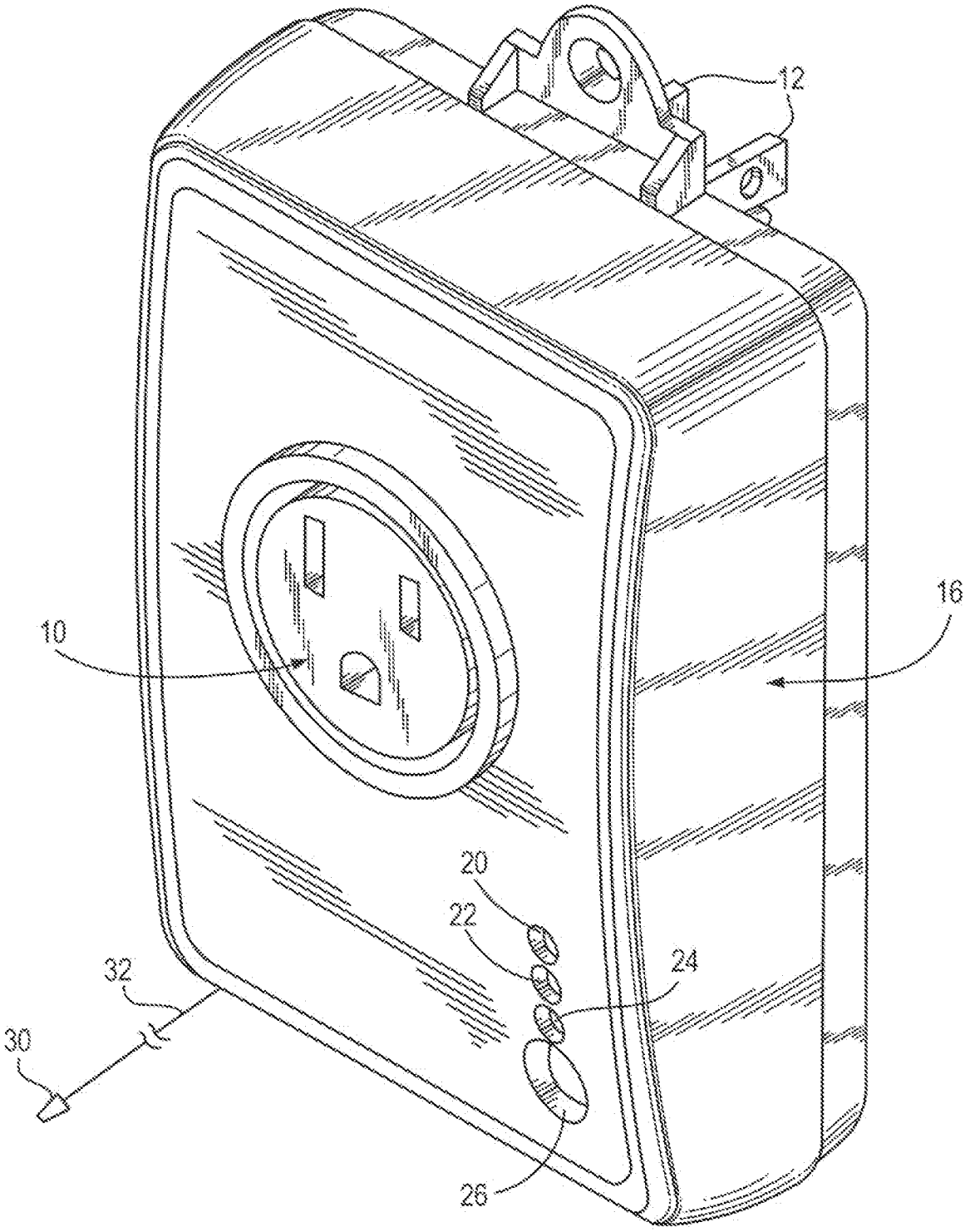
FIG. 1 is an isometric sketch of the outer case of the external electronic pump controller of the present invention.

Referring to FIG. 1, there is shown the external programmed control unit of the present invention. As shown this control unit includes an outer case, generally indicated by the numeral 16, which, on its front face, has socket openings 10 to receive a conventional three-prong electric plug, three LED indicators 20, 22, 24, and a toggle switch 26, all on its front face. Protruding from the rear face is a three-prong standard plug 12 intended to be inserted into a three-prong wall outlet standard in the United States. Alternatively, the prongs on the back and the receptacle on the front face can be made in accordance with the standards in any other country. The case can be, e.g., 3 in.×5 in.×1.5 in. in size.

Figure 2:
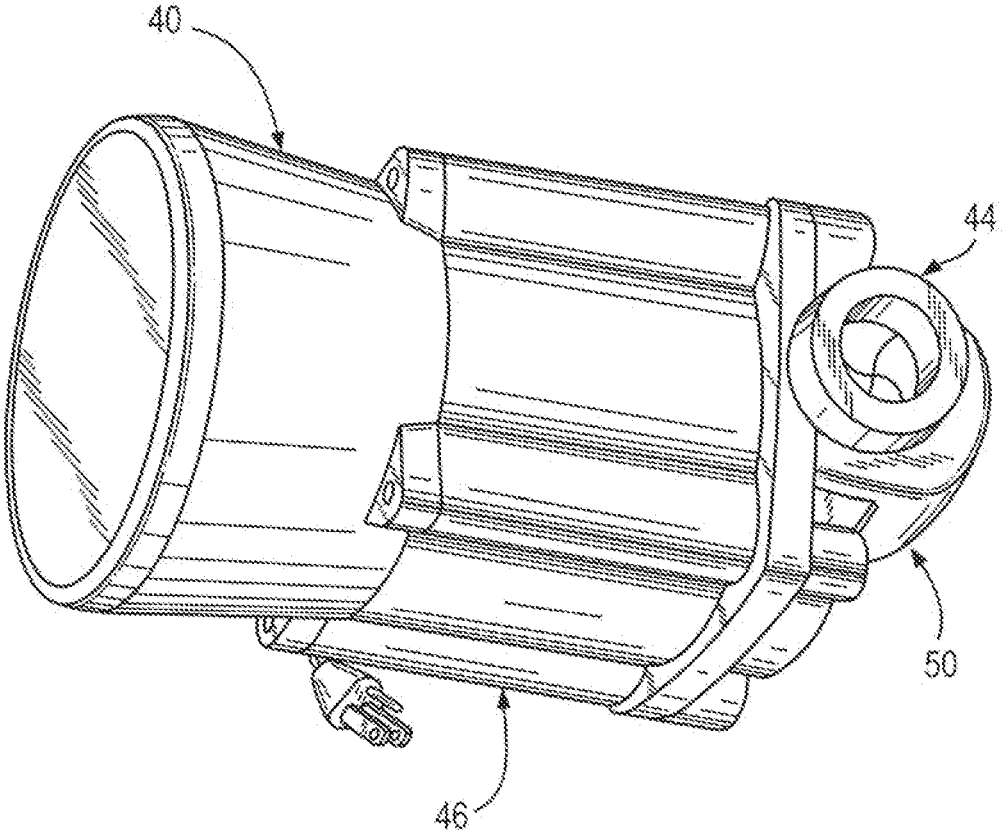
FIG. 2 is an isometric drawing of one view of a preferred electric motor powered centrifugal impeller pump, generally found to be most useful in combination household pumping systems and with the external controller of the present invention.

FIG. 2 is an example of a commonly used rotary impeller pump operated by a motor powered by household electric current.

Figure 3:
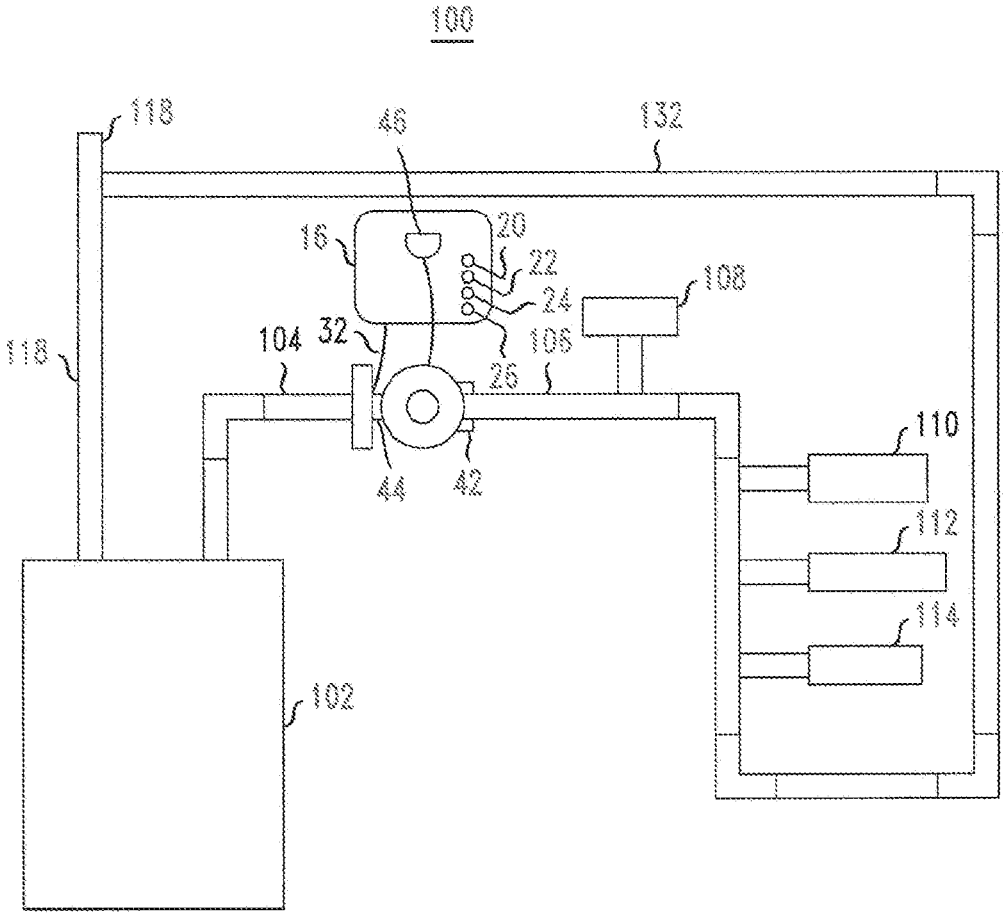
FIG. 3 is a diagrammatic picture of a standard plumbing system in a single family home in the United States, which includes the external controller operating a previously installed manually controlled 'dumb' pump providing, continuous hot water recirculation.

Referring to FIG. 3, the system of this invention is shown in the context of a closed water system of a household. The system has a hot water tank 102 which receives cold water via pipe segment 118 and generates hot water provided to the water system via pipe segment 104. The system pressure moves the water to the several locations having hot water taps 108, 110, 112 and 114.

When set to the automatic mode, with the toggle switch 26 on the external controller 16, the water pump 40 pumps the hot water in accordance with the method of the present invention as described herein. The various hot water taps, shown in FIG. 3, are in typical locations (e.g., kitchen, bathroom sink, tub/shower, laundry) in a household where hot water is used for various purposes. The motor pump 40, 42, 44 is powered through power cord 46 connected to the AC outlet socket 10 in the control unit 16, for providing power. The water pumping mechanism requires relatively low power, allowing the power to flow through the small external control unit, as the pump motor is limited to not more than 0.5 horsepower, drawing not more than 6 amps of current from a regular U.S. household socket, i.e. providing 60 cycle, 110 Volts current. Microcontroller 16 can be any relatively inexpensive commercial microprocessor or microcomputer integrated circuits that can be programmed with commands using many commercially available software packages. The programming language can be any well-known High Level programming language, such as ANSI C.

The selector switch or push button 26, toggles the control unit between the Smart and Pulse modes, manually, overriding the microcontroller when desired. One or more external temperature sensors 30, or sensors of other physical parameters, can be connected to the control board microcontroller, located within the case 16, by a wire 32 (in this embodiment) passing through the lower edge of the case 16. In use, the sensor 30, as shown in FIG. 3, is connected into the domestic hot water pipe 33, before the first plumbing branch. The external control unit 16 is plugged into a wall socket, not shown, by rear plug 12. If desired the electrical socket can be located away from the pump, and a longer power cord 47 can be provided, between the Control Unit and the pump motor.

The electrically-powered water pump, generally indicated by the numeral 40, is preferably installed in the hot water line 61 in close proximity to the water heater, or other source of hot water. Such a pump can easily provide for the recirculation of hot water so as to provide immediate hot water when the hot water tap is turned on, by pumping the hot water through the recirculation line 132, when none of the hot water taps are opened. As shown in FIG. 3, the house water system is a substantially closed loop, when the water taps are all closed, resulting in an extremely small pressure drop between the hot water line 104, 106 and the cold water line 118. This permits the utilizing of a minimal sized pump to provide the additional small amount of pressure differential required for this recirculation in a normal single family home with a water heater tank, for example as is typical in the United States ("U.S."). By circulating the hot water in this manner, all hot water taps, including showers, are made available to substantially instant hot water.

The circulator system includes the external electronic controller unit 16 shown in FIG. 1, and an electric motor pump 40. The external control unit includes a data receiving and recording function for receiving data from a temperature sensor and/or a flow sensor indicating when hot water is in use in a household. The controller uses the data received from the sensor(s) to determine the periods during each day that it will maintain hot water temperature to provide for substantially immediate hot water when a tap is turned on. During the initial logging period, when the controller was learning the periods, when the household is not using hot water, for example during a normal working day, the controller will activate the pump in pulse mode, all day long. However, once the controller completed the initial logging period, and learned when hot water is used, on any given day, it will operate the pump in pulse mode only during the hours of use, and will then turn the pump off during the next lengthy period of nonuse of hot water, e.g., overnight. The electronic controller 16 controls the pump motor switching the power source on or off, which determines when the pump operates.

In one preferred embodiment, as shown in FIG. 3, the outer housing or shell 16 of the external controller unit provides openings for three LED signal lights and a toggle switch. The signal LED's indicates a green light 20, when the power is on; a yellow indicator that changes to indicate the operating mode: e.g., steady yellow, when the controller is operating in the programmed mode, and there are no sensor errors: and continuously flashing when in the pulse mode; a red LED to indicate a fault in the system, e.g., a slow blink, e.g., one per five seconds, a faster blink, indicating an open sensor, e.g., two blinks per 5 seconds; the fastest blink to indicate a blown fuse, e.g. 3 blinks per 5 seconds.

Due to the low current flow required by the pump, all of which flows through the controller case, the case can be very small, e.g., 3 ins×5 ins.×1.5 ins. There is little or no need for heat control. The fuse prevents current flow of greater than e.g., 6 amps. There is a resettable, or replaceable, fuse installed along the bottom edge of the case 16.

The electric motor, in the context of the private residence, is usually a centrifugal pump, where the motor rotor is mechanically directly connected to a centrifugal impeller (both within the pump housing 40). Alternatively, any other type of electrically powered small pump can be operated by the external controller of this invention.

Figure 4:
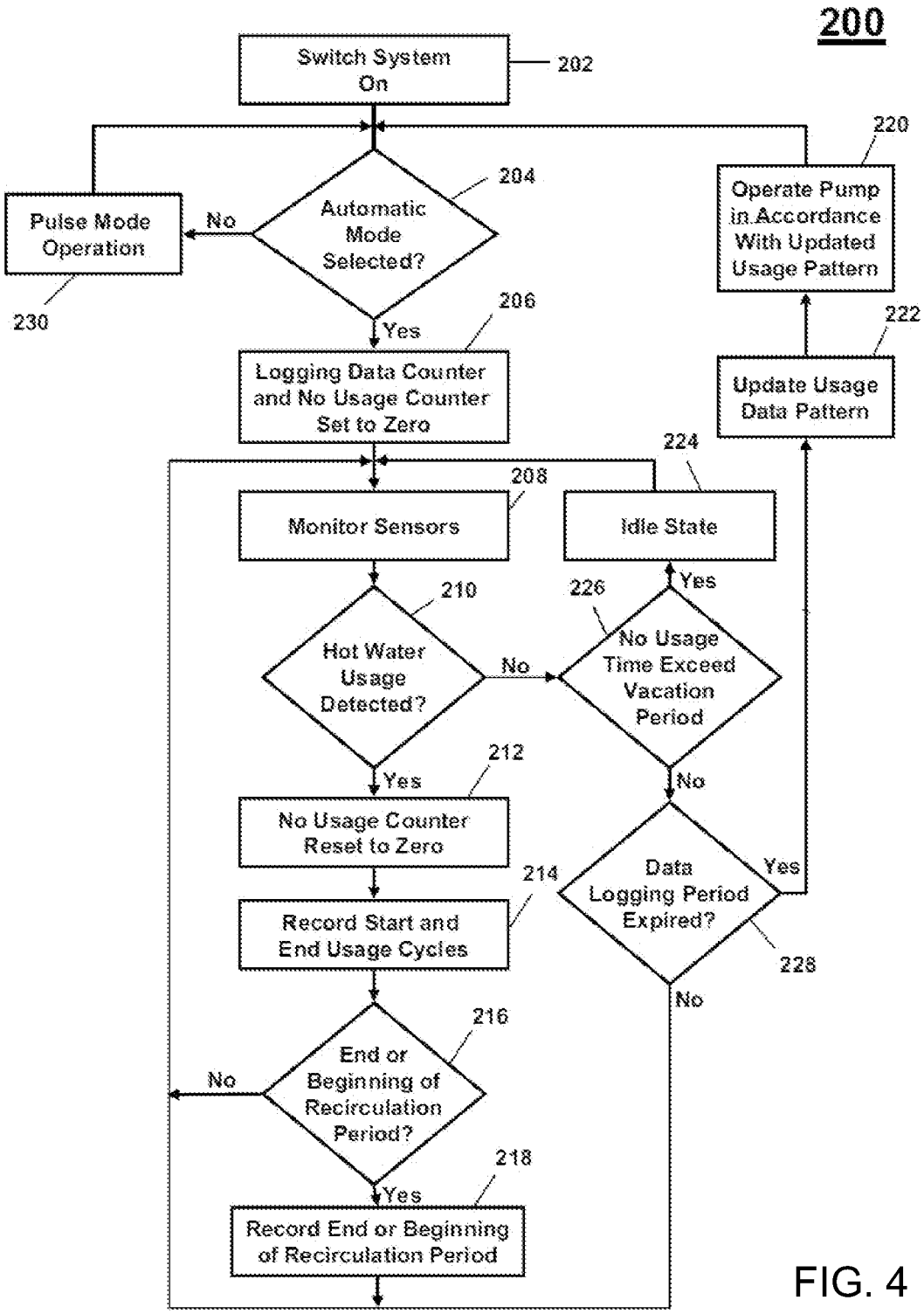
FIG. 4 is a flow chart representing the operation of the smart pump in automatic mode or pulse mode, as controlled by the external electric controller of the present invention, for the system shown in FIG. 3.

Referring now to FIG. 4 there is shown an example of a flow chart of the method of the present invention. Initially, power is provided to the microcontroller 16 for the smart pump 40 of the present invention in step 202. In step 204, microcontroller 122 reads the status of its input port corresponding to the AUTO switch to determine whether a user of the smart pump has switched the smart pump to automatic operation. If automatic operation is not selected, the method of the present invention moves to step 230 and enters the, e.g., PULSE mode wherein the smart pump continuously pumps water (regardless of the sensor output) for a period of, e.g., 75 seconds every 15 minutes, or it can be in the Off mode, where the pump is not operating. As FIG. 4 shows, the smart pump of the present invention will remain in an operating mode, e.g., the PULSE mode of operation, or Off, until the AUTO switch is manually set to the automatic mode.

The method of the present invention moves to step 206 when microcontroller 122 has detected that AUTOMATIC operation has been selected. In step 206, microcontroller 122 initializes a counter (i.e., a timer) that is to indicate the logging period during which various usages of hot water are detected, the length of time of each of said usages, and the beginning and end of each of said usages. Documenting the time at which the initial daily hot water usage is detected, the length of each said usages and the beginning and end of each said usage, for each day, constitutes the logging of water usage. These various usages are logged within a certain time period and thus this period (typically 7 days) is referred to as the data logging period.

Also, in step 206 another timer can be provided (called the no usage counter) which can be set to measure any period of no hot water usage that exceeds a certain threshold. For example, the threshold may be set to 36 hours. If no hot water usage is detected for 36 consecutive hours, the method of the present invention will cause the smart pump to enter into an IDLE or Off, mode of operation during which the smart pump does not pump any water until it detects hot water usage or detects a signal to restart. Thus, for example, after step 206, the method of the present invention moves to step 208 wherein microcontroller 122 monitors the sensor(s). If hot water usage is not detected, the no usage timer continues to measure the time of no usage and when that time exceeds a predefined period (36 hours, in our example) the smart pump enters the IDLE mode but the microcontroller continues to monitor the sensor(s). This is reflected by steps 208 to 210 to 226 to 224 and then back to step 208. The method of the present invention will remain in this IDLE loop defined by the aforementioned steps until it detects hot water usage or is signaled to restart. Note that during the IDLE mode of operation, the timer measuring the data logging period is also running. This will allow the pump to remain idle if there are days during the data logging period (e.g., 7-day period) when there is no hot water flow. Examples of no hot water usage include time periods when no one is occupying a residence due to vacation or occupants are away for a weekend for example.

The method of the present invention then moves to step 212 where detection of hot water usage by a sensor has occurred and the resulting sensor signal is read by microcontroller 122. In step 212 the method of the present invention resets the no usage counter to zero time. Effectively, each time hot water usage is detected, the no usage counter is reset to zero. In step 214, start and end usage cycles (e.g., the daily start times and end times of hot water usage) of the detected water usage are detected, for each day, but a pre-run period of X minutes and a post-run period of Y minutes is recorded or logged for the start usage cycles and end usage cycles respectively. For example, if on a Tuesday, hot water usage is detected at 8:10 am by the temperature sensor of the controller, then the following Tuesday, the pump will be controlled to operate in pulse mode to insure hot water will be promptly supplied to the fixtures starting at 7:10 am and ending at 9:10 am; here X, the pre-run period is 60 minutes and Y, the post run period is also 60 minutes.

In another example, if a shower was used on a Friday starting at 6:00 am and ending at 6:15 am, then the following Friday, the pump will be controlled to operate in pulse mode so that hot water will be pumped through the system including that shower starting at 5:00 am until 7:15 am, so that X is 60 minutes and Y is 75 minutes. It will be readily obvious that the length of the X and Y periods is arbitrary and different X and Y times can be programmed as desired. Also, the X and Y times need not necessarily be equal to each other. X and Y are variables representing time periods in minutes, hours or seconds or any combination thereof.

Throughout the data logging period, the method of the present invention determines e.g., daily start cycles and end cycles as follows. The start of a usage cycle is determined by a sudden increase in the temperature in the hot water line, which indicates a flow of water through the hot water line, as occurs when a tap is opened. Alternatively, the start of a usage cycle is determined by a time rate of change of water temperature of K degrees per L minutes after the pump has been off for M minutes or when the pump has been off for P minutes and the water temperature remains "hot." A "hot" water temperature is defined by a particular temperature deemed to be "hot" by the sensor(s) communicating with the microcontroller 122. That is, the sensor(s) can be set at a particular threshold temperature which if surpassed by the flowing water will cause the sensor(s) to indicate detection of "hot" water. An end usage cycle is defined as a no usage period of Z hours of no usage; for example Z can equal to 2.8 hours. The variables K, L, M, P and Z represent real numbers greater than zero.

A start usage cycle can represent the start time of a recirculation period. An end usage cycle can represent the end time of a recirculation period. That is, a recirculation period is defined by the period encompassed by a stored start usage cycle time and a stored end usage cycle time. A recirculation period may, therefore, comprise one or more start/end usage cycles. In steps 216 and 218, the start and end of the recirculation periods are thus determined from data gathered by the smart pump from the prior data logging period. At the end of the first logging period, the pump will operate during a second logging period in accordance with the data logged and accumulated during the first logging period.

During the second and subsequent logging periods, while the pump is operating in accordance with the usage cycles defined from the previous data logging period, the sensors and microcontroller continue to operate in accordance with the method of the present invention and continue to measure, log and record the times of hot water usage and uses the new data to determine the times of operation of the pump for the succeeding data logging period; the recirculation periods are thus continually updated. The method of the present invention continues to log data for the duration of the logging period (e.g., 7 days). Once the data logging period expires at step 228, the hot water usage data pattern that has been logged by the controller is used to update the operation of the smart pump in step 222. In step 220, the pump is operated in accordance with the updated hot water usage data pattern for at least another data logging period and the method of the present invention continues to monitor and log (or record) new data usage times while the smart pump is operated as per the last updated data pattern.

In one embodiment of the present invention, the data measured determines the earliest and latest times that hot water is used during any day of the logging period, and sets those times as the beginning and end of the pump operation during every day of the succeeding logging period. However, another embodiment can be used to log the usage times for each day of the week, and change the usage times accordingly. For example, during Monday to Friday of the week, the usage times start and end earlier each day. On the weekends, the usage times can start and end later each day.

The external controller can be configured with a built-in power source (or with a steady state mdata bank) so that although the smart controller may not be able to cause the pump to operate to pump water during a power outage, when power is restored, the smart pump can return to its operating mode status immediately prior to the power outage. Another embodiment of the external controller, which does not include means to maintain the data, will start a new data logging period upon restoration of power, the previous data having been lost when power is lost. Similarly, the microcontroller may have an initial setting pre-programmed in its system that will operate the pump during the initial start-up logging period, based upon the common usage of the general population, or it may be programmed when purchased to meet the requirements of the individual purchaser.

The above examples and descriptions are intended to be exemplary only. It is understood that one of ordinary skill in the art will comprehend the full scope of this invention to be set only by the scope of the claims set forth below.

What is claimed is:

1. A residential building having a plumbing system, the residential building plumbing system comprising:

a closed recirculating hot water line, the closed recirculating hot water line comprising:

a hot water source, a cold water inlet to, and a hot water line outlet from, the hot water source, the cold water inlet to the hot water source also being in fluid flow connection to a cold water source; at least one hot water tap in fluid flow connection to the closed, recirculating hot water line, and an electric motor pump for pumping hot water from the hot water line outlet from the hot water source through the closed recirculating hot water line, so as to permit continuous recirculation of hot water, to provide hot water at every hot water tap;

the electric motor pump comprising an electric motor generating up to 0.5 horsepower, and a pump impeller, the pump impeller being designed to be driven by the electric motor, and a removable electric conductor designed to connect the electric motor to a source of electrical power;

the plumbing system further comprising:

a self-contained, smart external power controller switch for the pump system, the self-contained, smart external power controller switch comprising:

a closed outer shell, an electrical power connection for releasably connecting the smart external power controller switch to an external power supply, a programmable microcontroller within the closed outer shell for controlling the flow of power to the electric motor pump received from the external power supply, and an electrical conductor connection designed to releasably connect with said electric motor pump to provide power for the electric motor pump when permitted by the smart external power controller switch, the smart external power controller switch being designed to operate by passing or switching off a flow of alternating current of up to 6 amps;

a time clock;

a temperature sensor attached to the closed recirculating hot water line upstream of the electric motor pump and downstream of the hot water source;

a database in electronic connection to the temperature sensor, for receiving, logging and recording data signals from the temperature sensor indicating the times when a flow of hot water occurred; and a software algorithm in the microcontroller for instructing the microcontroller to operate the water pump mechanism at predetermined times based upon the previously logged and recorded data signals logged and recorded in the database, by causing the switch to open and close thus controlling the flow of electrical power to the electric motor pump in accordance with the software algorithm on the programmable microcontroller within the closed outer shell of the self-contained, smart external power controller switch.

2. The residential building plumbing system of claim 1, wherein the smart microcontroller switch is programmed to permit the microcontroller to continue to receive log and record data from the temperature sensor and to update the pre-defined data logging time period on an ongoing basis.

3. The residential building plumbing system of claim 1, wherein the smart controller switch is programmed to cancel all activity by the pump if there has been no hot water usage by the opening of hot water taps for a preset lengthy period of time.

* * * * *